US009045281B2

(12) United States Patent
Chhina

(10) Patent No.: US 9,045,281 B2
(45) Date of Patent: Jun. 2, 2015

(54) WASTE BAG REPLACEMENT CARTRIDGE SYSTEM FOR WASTE RECEPTACLES

(71) Applicant: Ramendra S. Chhina, Bethesda, MD (US)

(72) Inventor: Ramendra S. Chhina, Bethesda, MD (US)

( * ) Notice: Subject to any disclaimer, the term of this patent is extended or adjusted under 35 U.S.C. 154(b) by 88 days.

(21) Appl. No.: 13/975,426

(22) Filed: Aug. 26, 2013

(65) Prior Publication Data

US 2015/0053689 A1 Feb. 26, 2015

(51) Int. Cl.
*B65F 1/06* (2006.01)
*B65F 1/00* (2006.01)

(52) U.S. Cl.
CPC ..... *B65F 1/062* (2013.01); *B65F 1/067* (2013.01); *B65F 1/0013* (2013.01); *B65F 1/0006* (2013.01); *B65F 1/06* (2013.01)

(58) Field of Classification Search
CPC ..... B65F 1/06; B65F 1/04; B65F 1/0006; B65F 1/0013; B65F 1/0073; B65F 1/062; B65F 1/067
USPC ..... 220/495.07; 206/554, 485; 248/100, 99, 248/97
See application file for complete search history.

(56) References Cited

U.S. PATENT DOCUMENTS

| | | | | | |
|---|---|---|---|---|---|
| 730,082 | A * | 6/1903 | Bates | 220/574.3 |
| 1,912,860 | A * | 6/1933 | Ranhofer | 220/495.07 |
| 5,386,910 | A * | 2/1995 | Liss | 206/554 |
| 5,562,580 | A * | 10/1996 | Beasley et al. | 493/194 |
| 6,102,239 | A * | 8/2000 | Wien | 220/495.07 |
| 6,264,035 | B1 * | 7/2001 | Petrie | 206/554 |
| 2001/0002690 | A1 * | 6/2001 | Rosky | 248/99 |
| 2006/0249415 | A1 * | 11/2006 | Nyeboer et al. | 206/485 |

* cited by examiner

*Primary Examiner* — Stephen Castellano
(74) *Attorney, Agent, or Firm* — Michael L. Greenberg, Esq.; Greenberg & Lieberman, LLC

(57) ABSTRACT

A waste bag dispenser system is described which is comprised of track guides known as rails, and a replaceable waste bag cartridge attached to the bottom of the rails, which are preferably surrounded by screen walls. The waste bag cartridge stores a plurality of waste bags stacked on top of each other, connected temporarily in sequence. Each waste bag has multiple connecting tabs (T-bar tabs) affixed to the bag which align with and insert into a slot in the rails such that the tabs may only exit the slot from the top of the rails. The rails and waste bag cartridge are held in an aligned arrangement via either a clasping mechanism or a surrounding structure which inhibits the movement of both elements. Waste bags are pulled up from the waste bag cartridge to the top of the rails and held in place via at least one hook.

16 Claims, 17 Drawing Sheets

WASTE BAG REPLACEMENT CARTRIDGE SYSTEM FOR WASTE RECEPTACLES

FIELD OF THE INVENTION

The present invention relates to a waste bag dispensing apparatus, and more specifically, an apparatus configured to simplify the act of waste bag removal and replacement via a waste bag cartridge system. The cartridge system provides a new waste bag available for immediate use when a used waste bag is removed, while preventing the vacuum sealing of a used waste bag along the sides of the receptacle.

BACKGROUND OF THE INVENTION

Conventionally, it is known that trash cans are often lined with plastic bags in order keep the trash can itself from becoming soiled, and to serve as a convenient way to remove all of the disposed trash by removing the liner. It is therefore convenient to have a supply of liners available near the receptacle to quickly insert a replacement liner once a full liner is removed. Removal of a filled liner requires grasping the liner and pulling in an upward motion. If the liner is filled such that it is in contact with the receptacle a vacuum seal can be formed making the removal of the filled liner very difficult sometimes even resulting in the tearing of the liner. Not having bags (liners) near to the receptacle and the potential of a vacuum seal inconvenience the user.

Once a liner is retrieved from its storage location it must be unfolded and opened at the mouth such that trash may be deposited into the liner. Inserting the liner inside the trash receptacle often requires you to insert an arm into the liner to open the liner, push it into the receptacle, and finally secure the liner at the top of the receptacle so it does not fall into the receptacle as trash is dispensed into the liner. If the liner is not secured well at the top of the receptacle and falls into the receptacle, the individual must reach into the liner with trash already inside to retrieve the liner top and re-secure it to the receptacle. Having to secure a liner receptacle and retrieving it if it falls inside the receptacle is an inconvenience to the user.

Various means for providing access to liners are shown in the prior art. For example, U.S. Pat. No. 8,210,386 B2 granted to Barrett et al. on Dec. 11, 2008, discloses a cartridge attached to the inside surface of a trash container for storing a plurality of liners. Barrett provides ready access to individual liners dispensed by removing a single liner from the cartridge. Barrett further provides convenient access to liners by placing the liners in a cartridge inside the receptacle. However, securing of the liner to the top of the receptacle must be performed manually. Absent a method which ensures reliable securing of the liner at the top of the receptacle it is still possible for the liner to fall into the receptacle. As a result, the user would have to reach into a liner already containing trash to re-secure the liner to the receptacle. Barrett does not eliminate the need for the user to unfold and open the liner nor provide a solution if the liner is filled such that a vacuum seal forms making the removal of the full liner difficult.

U.S. Pat. No. 5,295,607 granted to Chin-Chiao Chou, Ping-Tung Hsien, Taiwan on Mar. 22, 1994, discloses a hollow casing which receives a rolled-up strip of garbage sacks and a clamping mechanism at the top of the receptacle to hold a liner in place. Chou provides ready access to the individual liners dispensed as a liner is removed and pulls an attached liner along with it to the top. However, the user must manually separate the top liner from the bottom liner which may be difficult as one hand must be used to hold the full possible heavy top liner while separating a transverse perforation connecting it to the bottom liner. This task may require pulling the bottom liner further out of the receptacle to separate the perforation thereby necessitating the user to manually re-insert the now separated bottom bag into the receptacle. As a result the liner following the bottom liner will have been pulled into the receptacle which would have to be bunched at the bottom of the receptacle reducing available space in the receptacle. Once a liner is aligned to the top of the receptacle a foot actuated clamping mechanism can be used to secure the liner to the top of the receptacle. However, the clamping mechanism requires that the liner be aligned properly between the receptacle and clamp to ensure liner is secured properly. Chou does not eliminate the need for the user to open the liner nor provide a solution if the liner is filled such at that a vacuum seal forms making the removal of the full liner difficult.

U.S. Pat. No. 2012/0055933 A1 granted to Scott M. Jones on Mar. 8, 2012, discloses a mechanism to assist in the removal of a full liner from a receptacle. However, Jones does not provide ready access to individual liners, a mechanism for securing a liner to the top of the receptacle, a solution to avoiding a vacuum seal from a full liner or a solution for having to unfold and open a liner.

U.S. Pat. No. 6,105,859 granted to Todd Stafford on Aug. 22, 2000, discloses a mechanism to storage compartment located at the bottom of a trash receptacle which contains a plurality of liners. Stafford provides ready access to individual liners dispensed by removing a single liner from the compartment. However, securing of the liner to the top of the receptacle must be performed manually. Absent a method which ensures reliable securing of the liner at the top of the receptacle it is still possible for the liner to fall into the receptacle. As a result, the user would have to reach into the liner already containing trash to re-secure the liner to the receptacle. Stafford does not eliminate the need for the user to open and unfold the liner nor provide a solution if the liner is filled such that a vacuum seal forms making the removal of the full liner difficult.

U.S. Pat. No. 5,628,424 granted to Stephen G. Gola on May 13, 1997, discloses a trash container having a bottom panel attached to base portion that dispenses either a continuous strip of perforated liners or a box of individual bags. Gola provides ready access to the individual liners dispensed by removing a liner from the panel by unraveling a continuous roll or an individual liner from the panel and a remedy to avoid a vacuum seal from forming. However, when unraveling the roll the user is faced with either first removing the liner entirely to separate a perforated connection between each bag then stuff the lower bag back into the receptacle and manually open the bag to reinsert into the receptacle and secure at the top of the receptacle. As a result, stuffing the lower bag into the receptacle reduces the available space in the receptacle inconveniencing the user. When removing individual bags the user must also manually open the bag and reinsert it into the receptacle and manly secure at the top of the receptacle creating an inconvenience for the user.

U.S. Pat. No. 5,704,511 granted to Kelly Kellams on Jan. 6, 1998 discloses a waste can with two chambers, one for holding a plurality of trash bags and a second to hold an opened trash bag to dispense trash. Kellams provides ready access to individual trash bags dispensed by removing the trash bag from a narrow channel which runs vertically from the bottom of the waste can to the top. However, when pulling a bag from the dispensing channel the user must first manually separate the perforated connection between bags then open and reinsert the bag into the receptacle ensuring it is secured at the top of the waste can. Kellams does not provide a solution to avoid a vacuum seal which could occur if the bag being dispensed is overfilled.

AU 2001100652 A4 granted to Peter Sarcasmo on Jan. 17, 2002 discloses A Bag Housing. Sarcasmo teaches a bag housing similar to that of the present invention in that it employs a cartridge containing a sequential series of waste bags, and is configured to deploy trash bags from within the waste can when a full waste bag is removed. However, Sarcasmo differs from the present invention in that the present invention employs a multi-point rail or interior track system configured to provide security and stability to the cartridge and waste bags contained within the receptacle, especially pertaining to when the waste bags are slid up from the bottom of the waste can or receptacle along the vertical rail or track. Additionally, the present invention employs a different method of retaining the waste bags within the receptacle when in the open position by providing a T-bar tab and nook configured to allow the waste bag to flex and move slightly, while ensuring that the opening of the waste bag remains securely at the top of the receptacle.

SUMMARY OF THE INVENTION

Wherever a trash can is used to collect refuse, it is common to use a plastic bag to line the trash can to hold the disposed materials. Once the bag is full or otherwise needing to be discarded, it is removed from the trash can and disposed of as appropriate for the waste collection method utilized by the community. The user removing the bag has to then insert another bag into the trash can so that additional refuse may be discarded to repeat the process.

Although there are numerous types of both trash cans and plastic bags, some common problems exist with the available designs. First, the bags are often designed with a generic size and capacity which may result in a poor fit within the trash can. Second, if a bag is filled to near capacity it may form a vacuum seal along the inside walls of the trash can making extraction of the bag from the trash can very difficult, and occasionally causing the bag to stretch or tear. Third, once a bag is removed, a replacement bag has to be located whether from an available supply inside the trash can or a supply in close proximity to the trash can. Fourth, once a replacement bag is located it must be opened from a folded state to separate the sides of the bag and aligned inside the trash can. Fifth, the replacement bag must be held in place atop of the trash can so that when refuse is dropped into the bag the bag does not fall back inside the trash can.

It is therefore the first object of the present invention to provide a trash bag dispensing apparatus which always dispenses a single bag positioned in an open state from within the trash can.

It is another object of the present invention to provide a replaceable cartridge containing a plurality of waste bags such that when a waste bag is removed from the trash can, the very act of removing the waste bag positions an empty waste bag stored within the cartridge into an open and ready-to-use position within the trash can.

It is another object of the present invention to provide a track system which guides a bag as it traverses from the cartridge vertically to the top of the tracks.

An additional object of the present invention is to provide a waste bag retaining mechanism located at the top of the track system which prevents a bag from collapsing or falling down back towards the cartridge.

Likewise, another object of the present invention is to provide at least one guide rail integrated into the aforementioned cartridge which align with the track system of the trash can, preferably located above the cartridge.

It is another object of the present invention to provide a method for multiple points of the bags, while inside the cartridge, to be inserted into the track system allowing them to slide along the rails.

It is another object of the present invention to provide a method for the top-most bag in the cartridge to be connected at the bottom to the next bag in the cartridge and the second bag to be connected at the bottom to the third bag at the top continuing in this fashion until the last bag in the cartridge. This connection between subsequent bags within the cartridge is preferably flexible and temporary, and is preferably facilitated via a perforation or weak adhesive.

It is another object of the present invention to provide a method such that when a bag is pulled vertically it travels along the track system integrated in the cartridge transitioning seamlessly to the waste bag retaining mechanism above the cartridge.

It is another object of the present invention to provide a method such that when a bag is removed by pulling vertically from the top of the track system, the action pulls a subsequent waste bag from the cartridge along the rails of the track system, positions the waste bag atop the track system and separates from the bag being removed, thereby making the waste bag ready for immediate use.

It is another object of the present invention to provide a method to prevent the formation of a vacuum seal conventionally caused by a filled or partially filled bag binding against the inside walls of the trash can.

Accordingly, there is a need for an apparatus which, when fitted into a trash can, will dispense bags sized to the trash can, eliminate the possibility of a vacuum seal, provide a replacement bag without having to locate a supply, and position the bag in an opened state without having to manually unfold the bag.

DETAILED DESCRIPTION OF THE INVENTION

Figure 1:
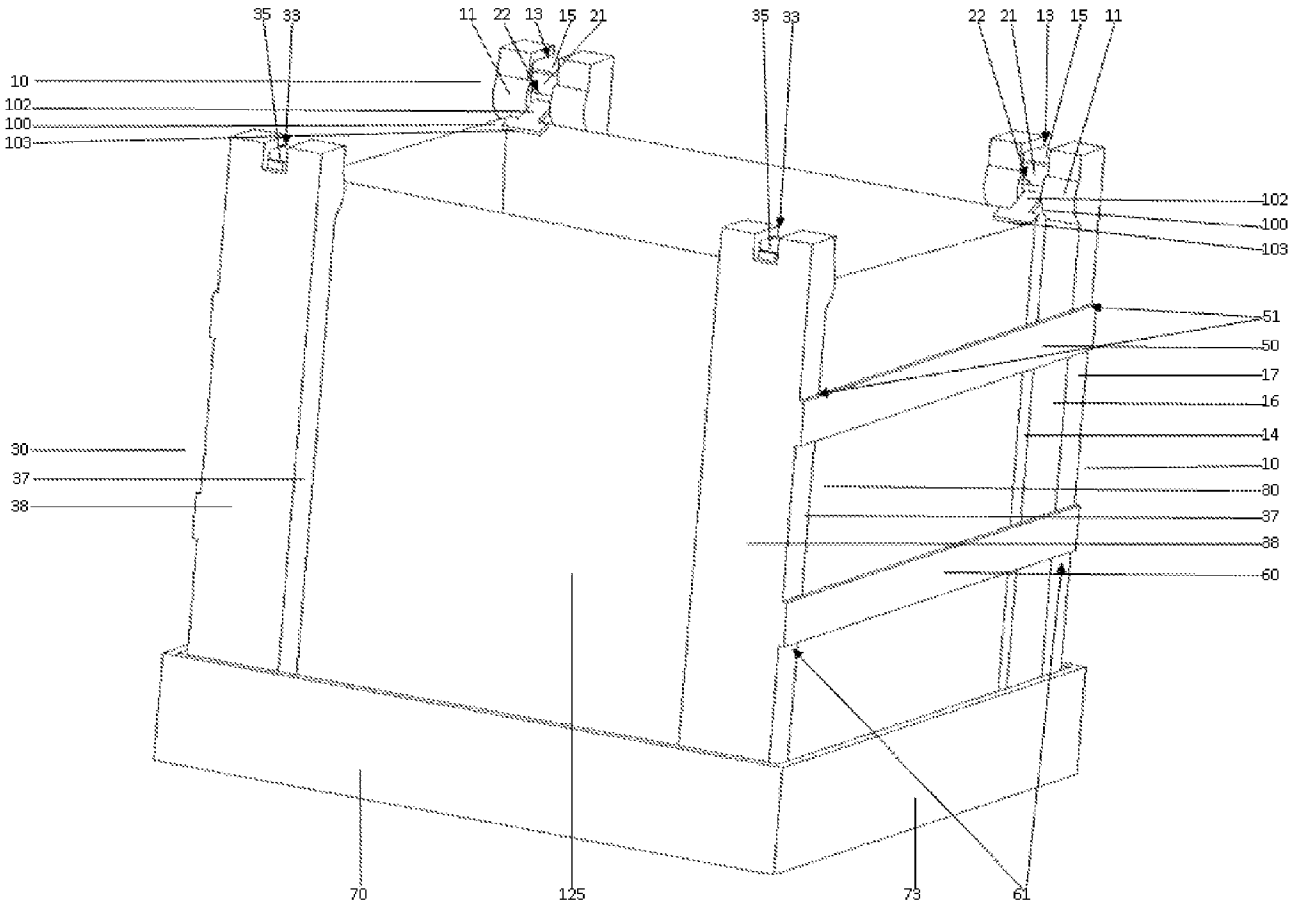
FIG. 1 exhibits a perspective view of the preferred waste bag apparatus with a waste bag cartridge, upper track guides, side rails and a waste bag. The front side rails have been removed from this figure.
Figure 2:
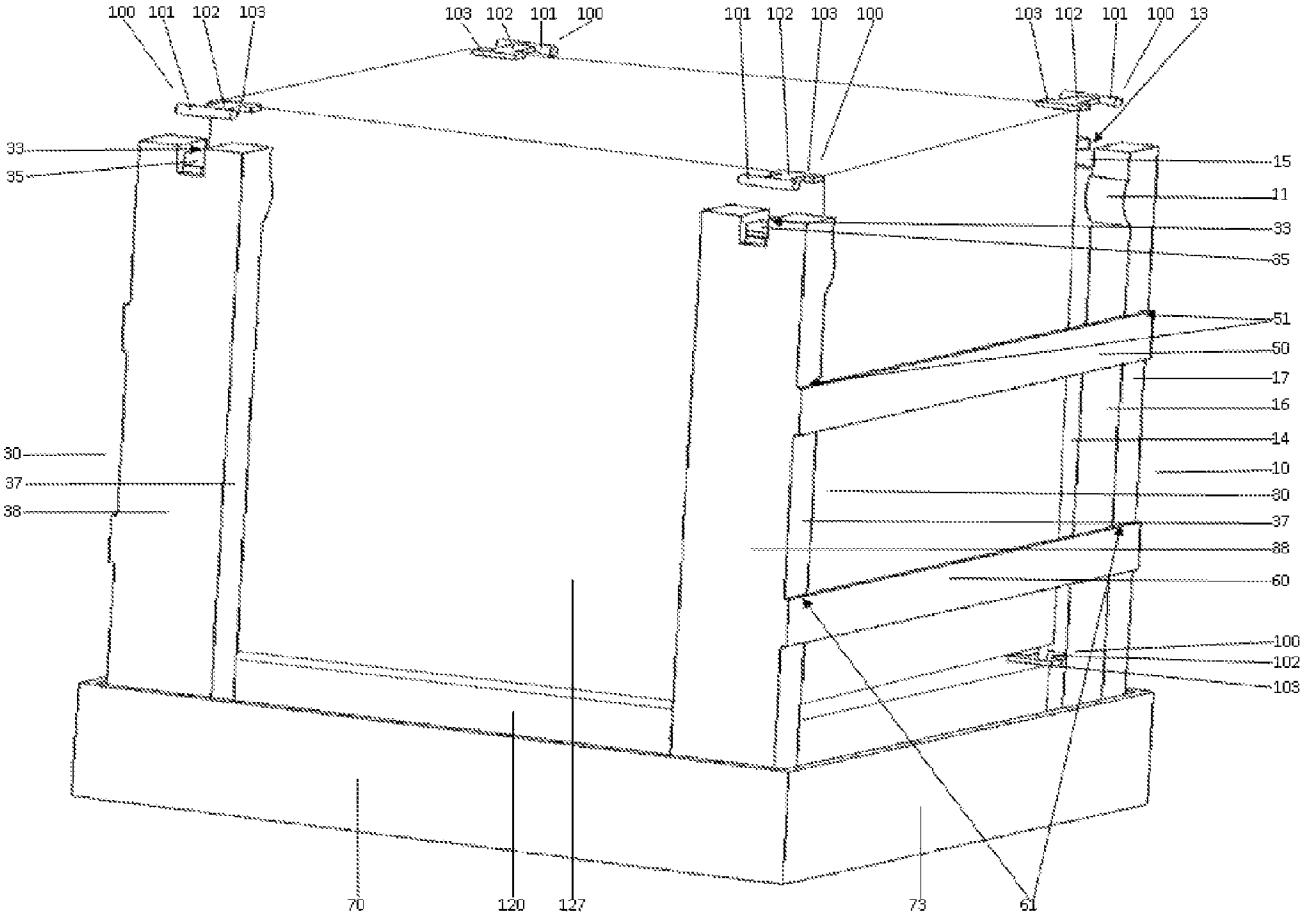
FIG. 2 is a perspective view of the preferred waste bag apparatus with a waste bag cartridge, upper track guides, side rails, waste bag exiting the apparatus and second waste bag. The front side rails have been removed from this figure.
Figure 3:
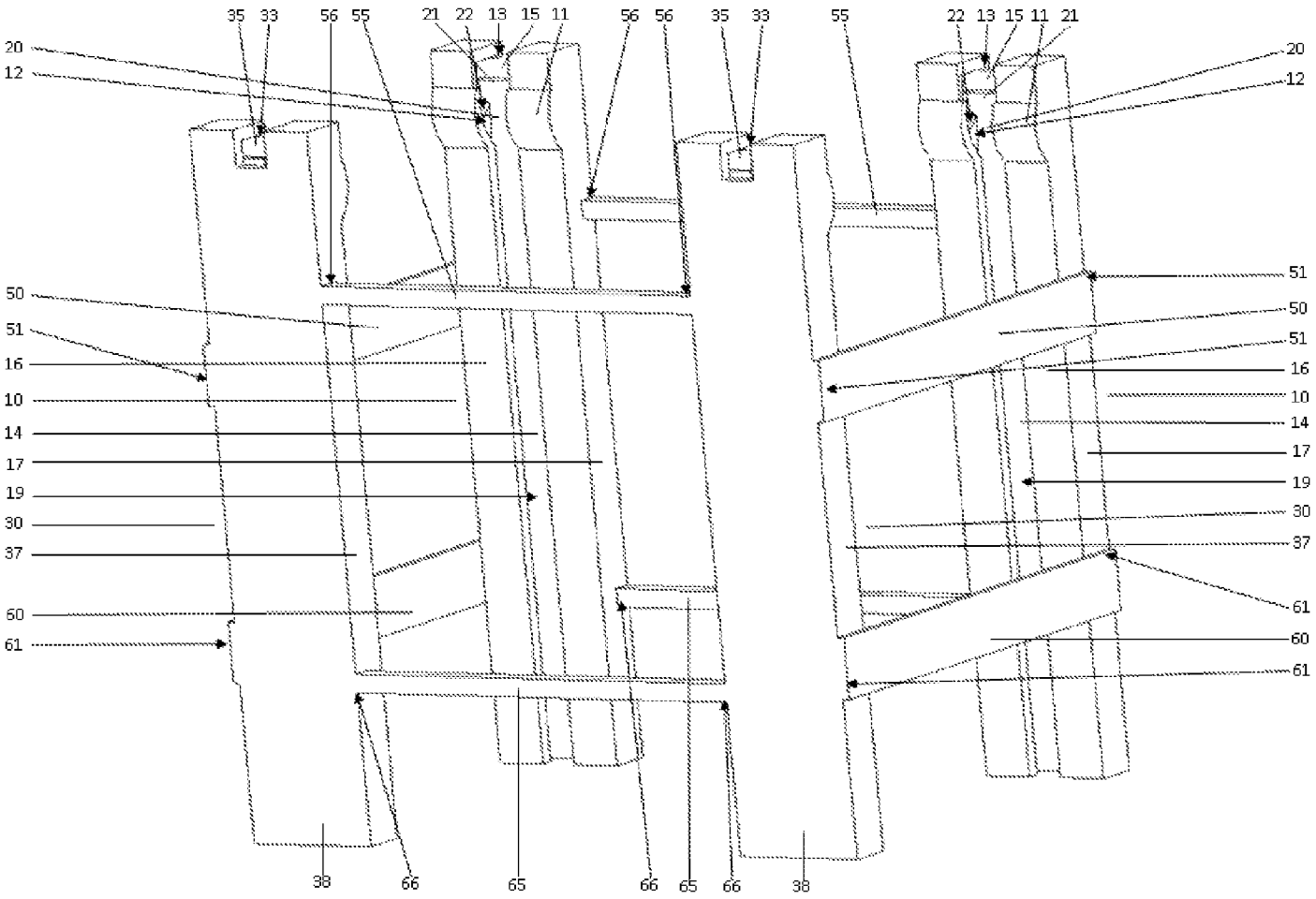
FIG. 3 is a perspective view of the preferred waste bag apparatus with the upper track guides.
Figure 4:
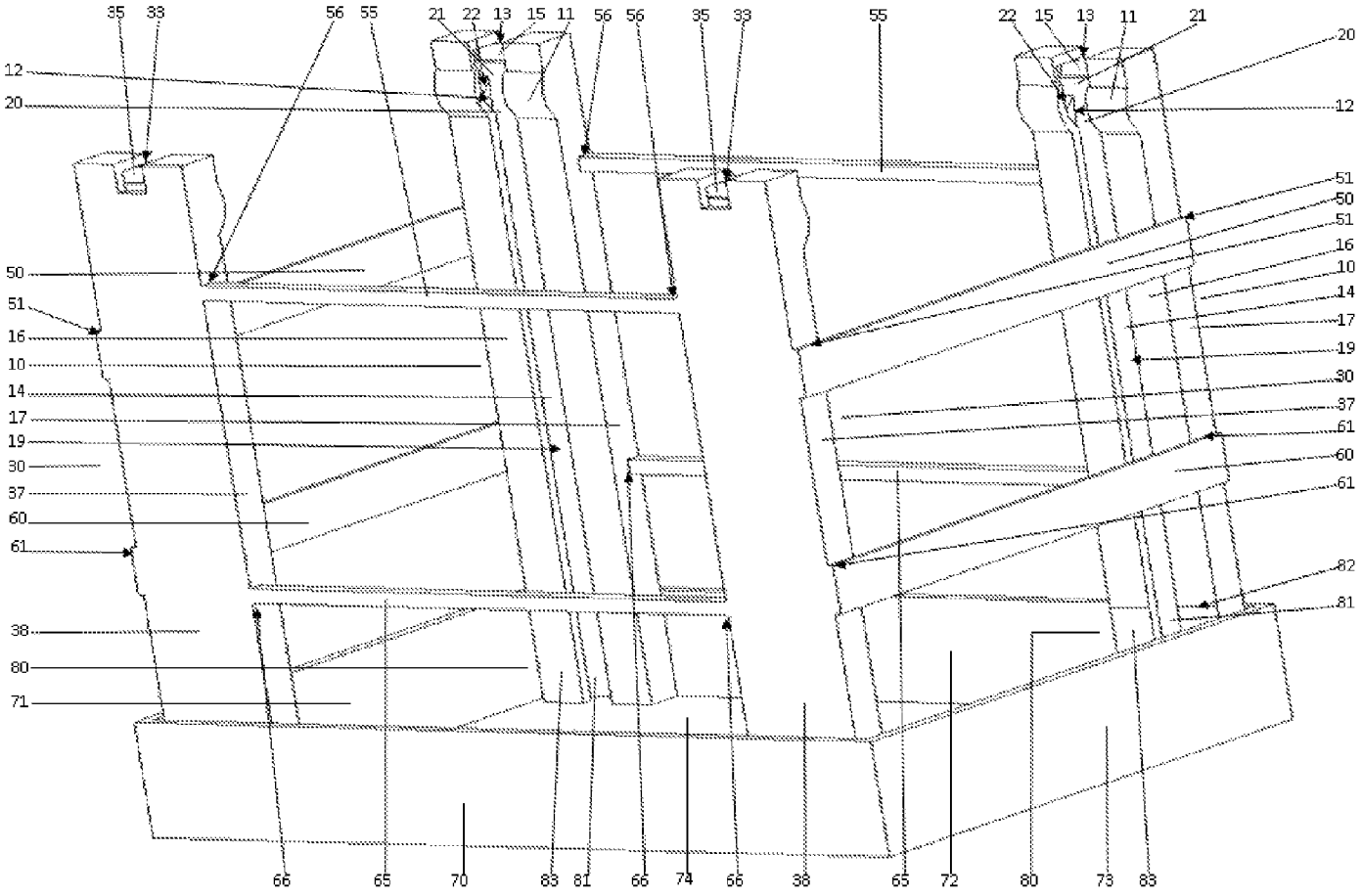
FIG. 4 is a perspective view of the preferred waste bag apparatus along with the waste bag cartridge.

The present invention is a waste management apparatus configured to facilitate a new method of trash bag removal and replacement. The present invention employs a waste bag cartridge (141) configured to seamlessly deploy waste bags (160) from within the receptacle of the present invention. As seen in FIGS. 1-7, the device of the present invention primarily consists of the unique waste bag cartridge (141) and the manner by which the cartridge (141) interfaces with the waste receptacle containing the waste and at least one of said waste bags (160). The waste receptacle employs an upper track guide system which employs at least one rail (10), preferably disposed at the corners of the receptacle, and is configured to guide the waste bags (160) into an ideal position for use via a proprietary tabbed system.

In the preferred embodiment of the present invention, four rails (10) are employed, one preferably located at each corner of the preferably square or rectangular receptacle. In alternate embodiments of the present invention, a cylindrical, trapezoidal, hexagonal, or other conventionally shaped receptacle may be employed with an alternate layout for the position of the rails (10) in order to accommodate customers that prefer an alternately shaped trash can. In alternate embodiments of the present invention, it can be envisioned that a receptacle could be configured with additional or fewer rails (10), such as three rails (10) or five rails (10) and still accomplish the goal of the present invention. An alternate waste bag cartridge (141) would then be designed to fit within and comply with the alternate rail layout. Each rail (10) is equipped with an exit opening (15, 35), a slot (14), a rail front (36), a rail rear (38), a rail side (37), and an inner slot area (39) as seen in FIG. 1 through FIG. 7. FIGS. 9-14 depict the attachment mechanism found at the top of each rail (10), and details the slot (14) and inner slot area (39) of the present invention. Each of the rails (10) are preferably equipped with a curved section (11), which is configured to facilitate the placement of the t-bar tabs (100) on to the hooks (32, 33) located near the exit opening (15, 35) of the rail (10). The hooks (32, 33) and the curved section of the rail (11) constitute the catch area (42) which prevents the t-bar tabs (100) from prematurely falling out of the rails (10) or from sliding back down the rail (10) towards the waste bag cartridge (141). It should be understood that the hooks (32, 33) are preferably conventional hooks, but can be any conventional retaining mechanism. The hooks (32, 33) are preferred because gravity combined with the action of pulling the waste bags (160) easily allows attachment and removal of the waste bags (160).

Figure 5:
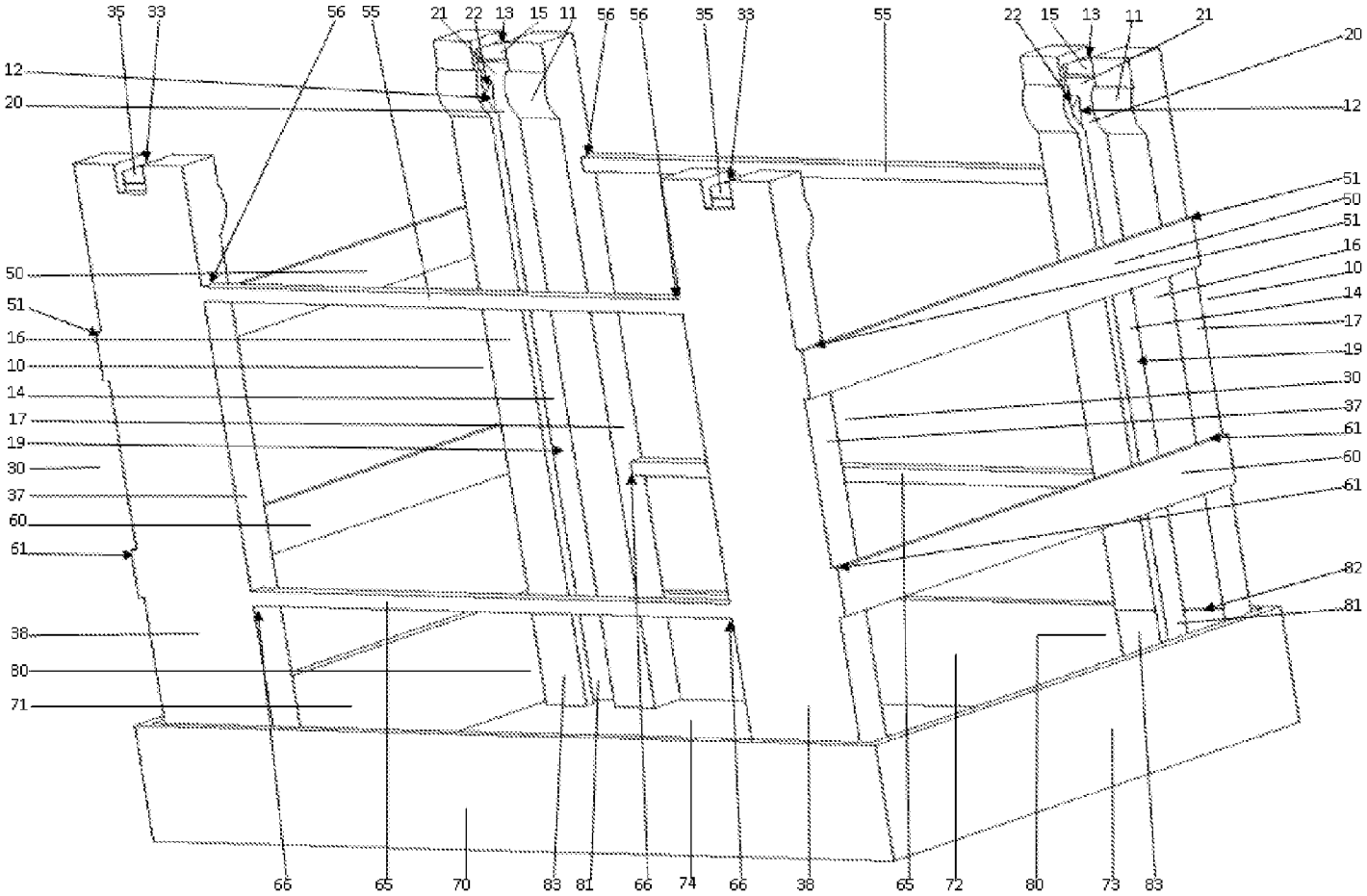
FIG. 5 is a perspective view of the preferred waste bag apparatus with a waste bag cartridge, upper track guides, side rails and a waste bag.
Figure 6:
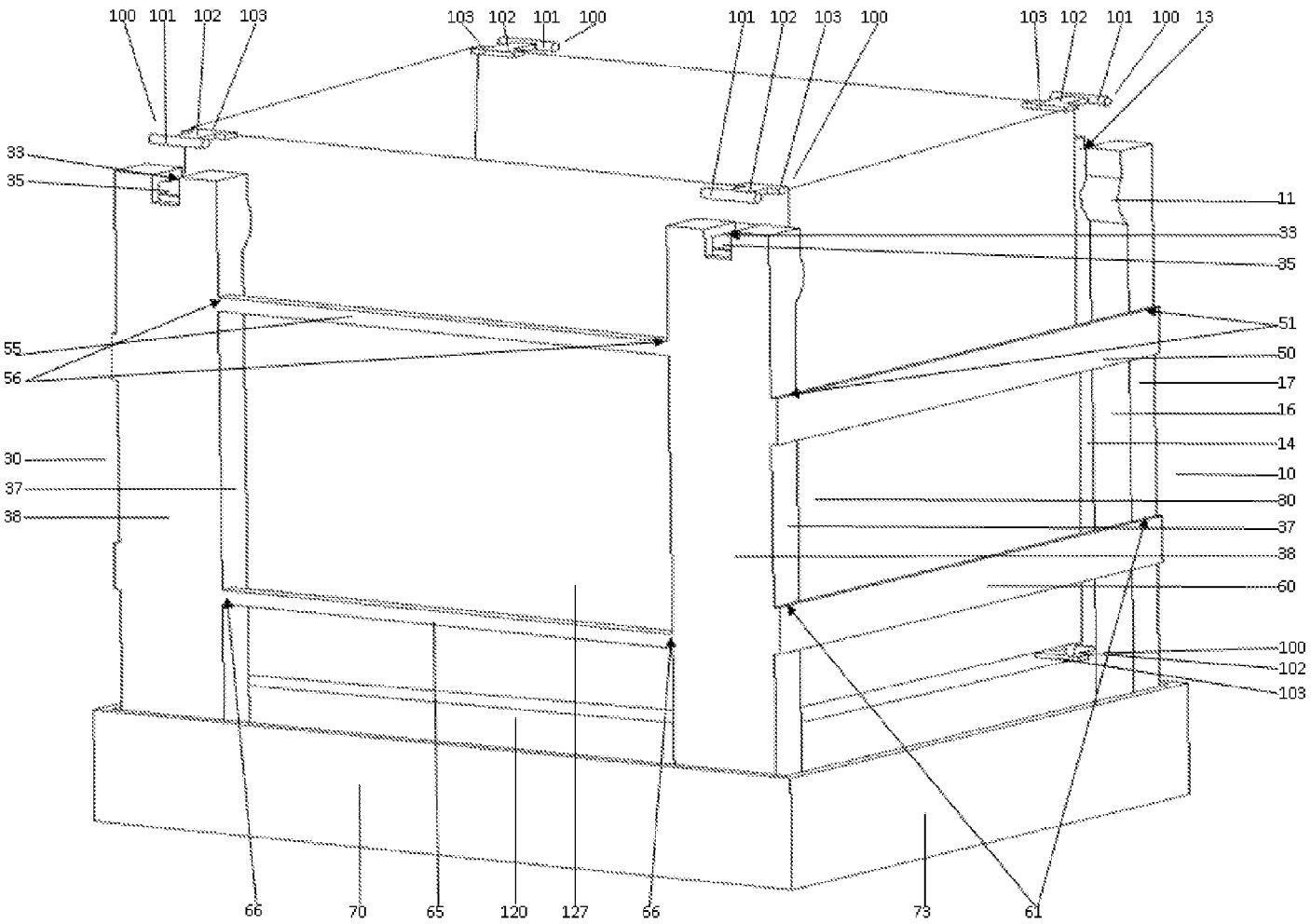
FIG. 6 is a perspective view of the preferred waste bag apparatus with a waste bag cartridge, upper track guides, side rails, waste bag exiting the apparatus and second waste bag.

A series of supporting bars, namely a top supporting bar (50), a bottom supporting bar (60), a bottom thin supporting bar (65), and a top thin supporting bar (55) extend horizontally between the rails (10) of the present invention, reinforcing the structure of the present invention and partially forming the sides of the receptacle. The top supporting bar (50), bottom supporting bar (60), bottom thin supporting bar (65), and top thin supporting bar (55) are securely affixed to the rails (10) of the present invention at connecting points (51, 56, 61, 66) as seen in FIG. 5. The supporting bars are designed to provide structure to the receptacle of the present invention, and reinforce the rails (10) to ensure that they remain perpendicular to the bottom of the receptacle, facilitating the seamless deployment of the waste bags (160) when needed.

Figure 12:
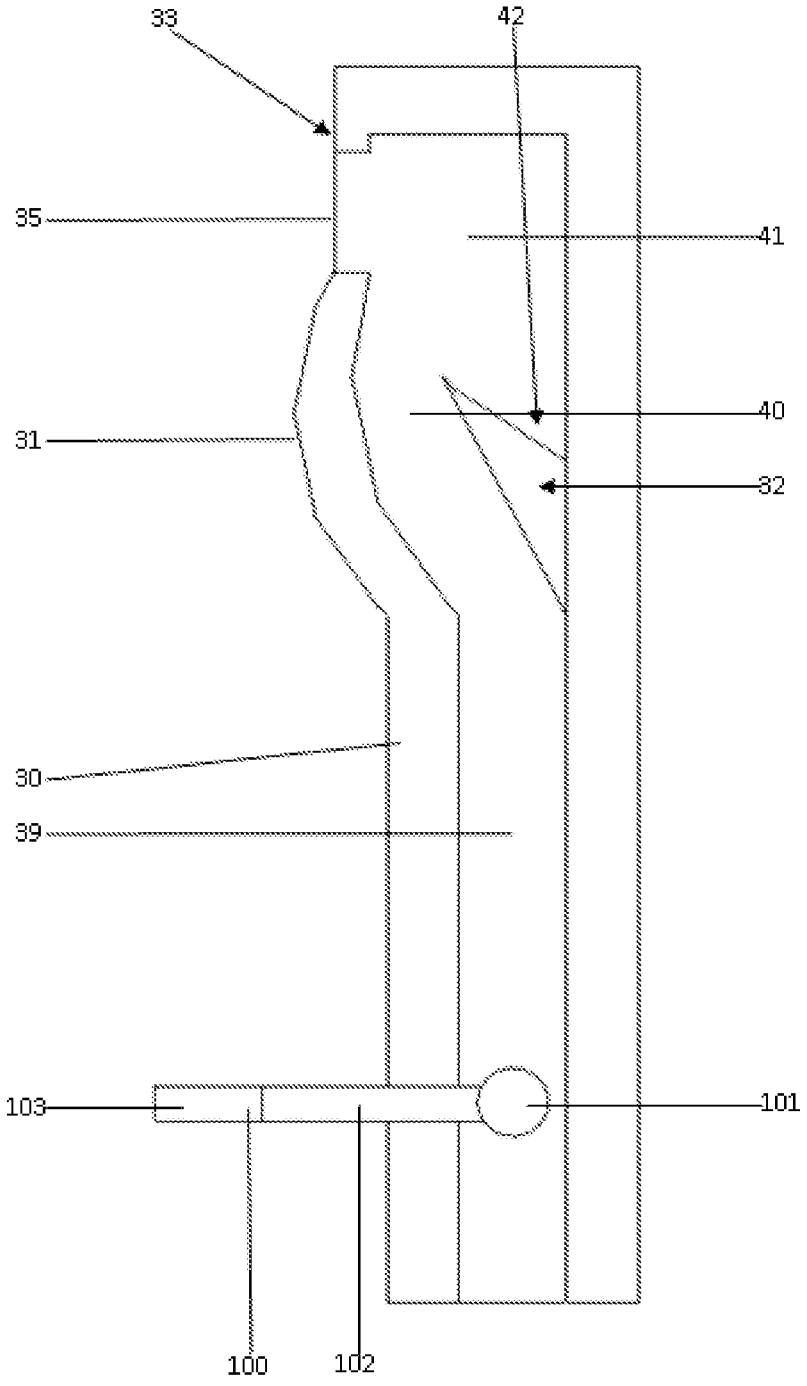
FIG. 12 exhibits a cross-section view of the top of the upper track guides with tab retention structure.
Figure 13:
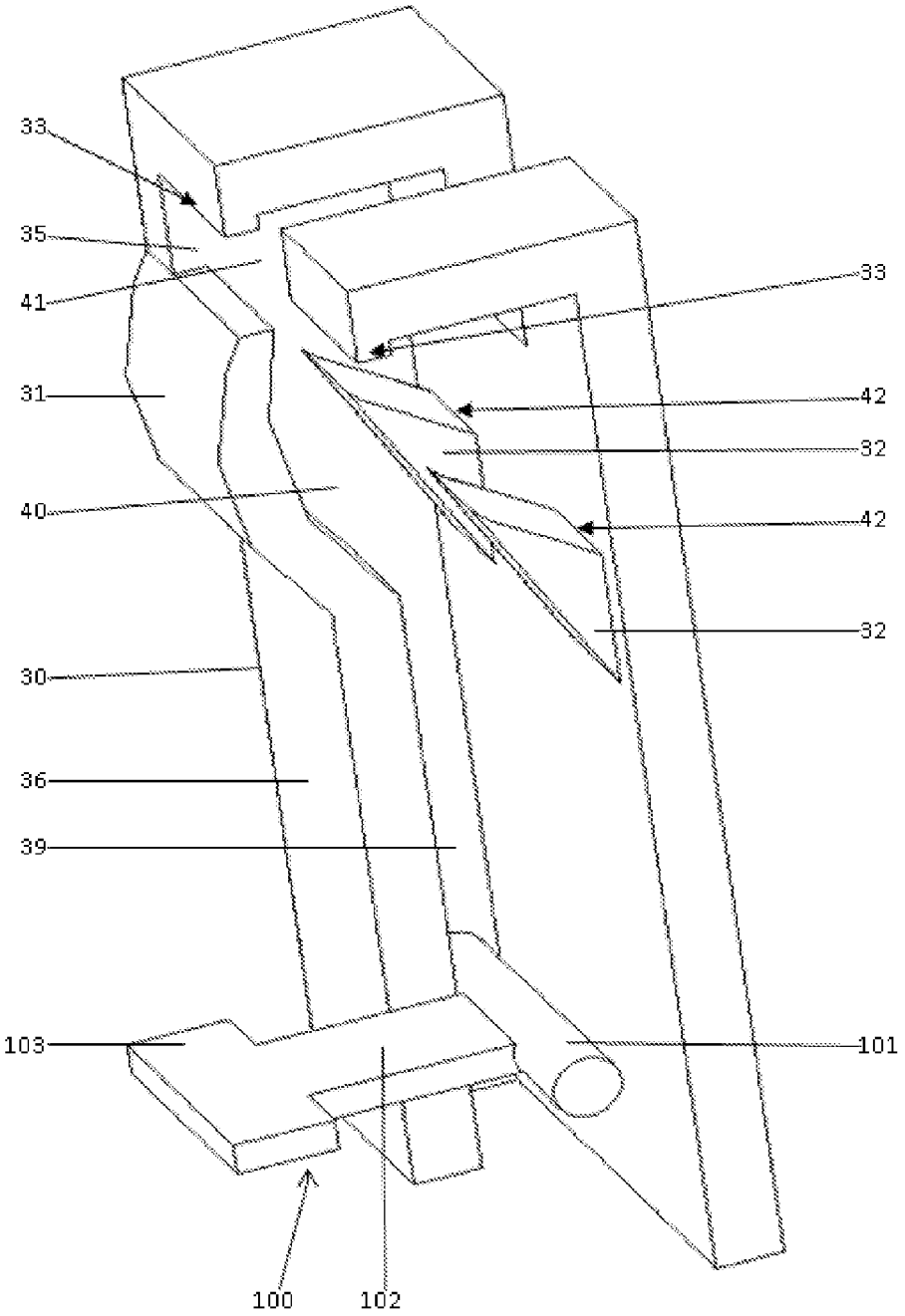
FIG. 13 is a cross-section view of the top of the upper track guides with a tab and tab retention structure displayed.
Figure 14:
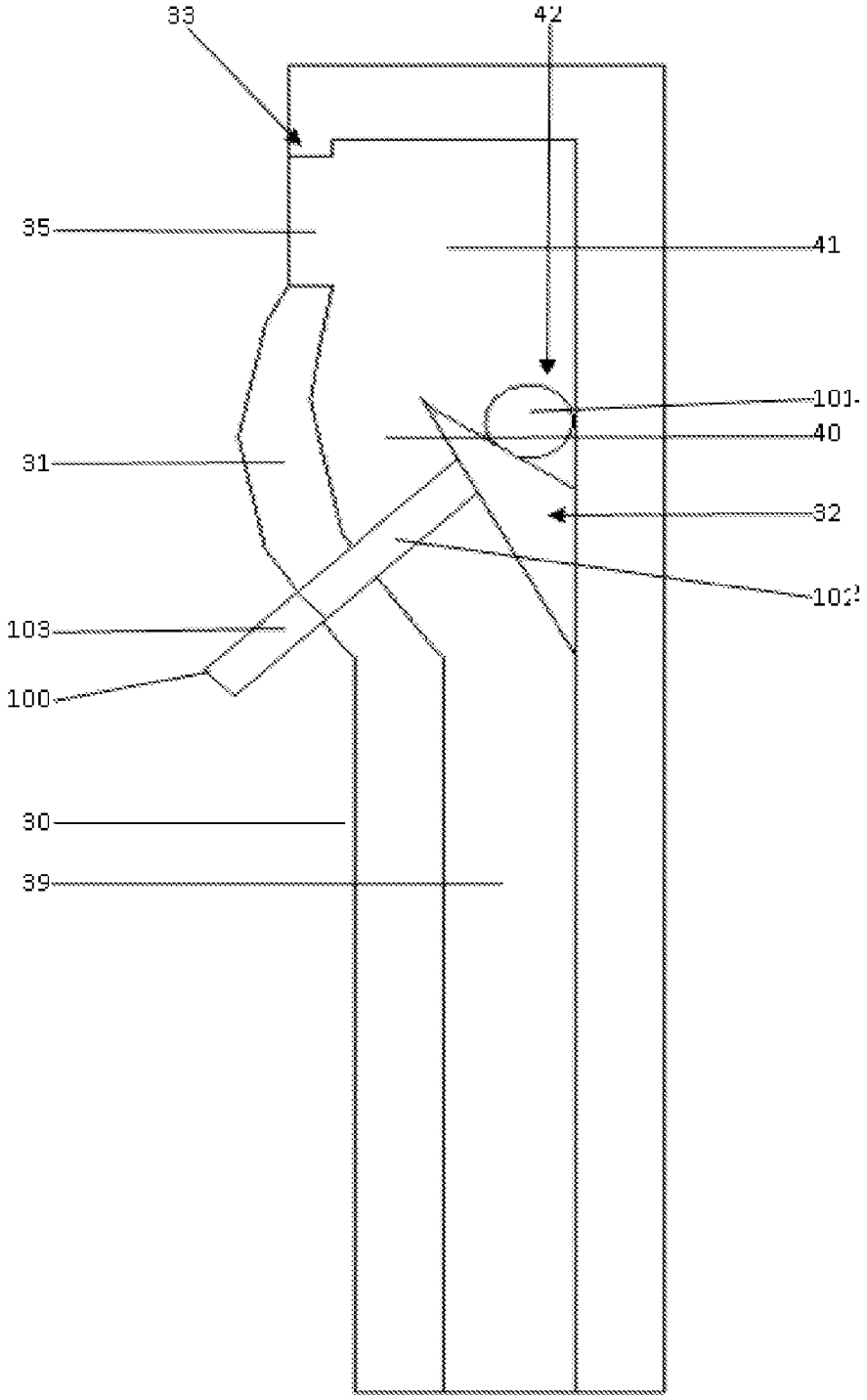
FIG. 14 is a cross-sectional environmental view of the top of the upper track guides with a tab in place in the tab retention structure.
Figure 15:
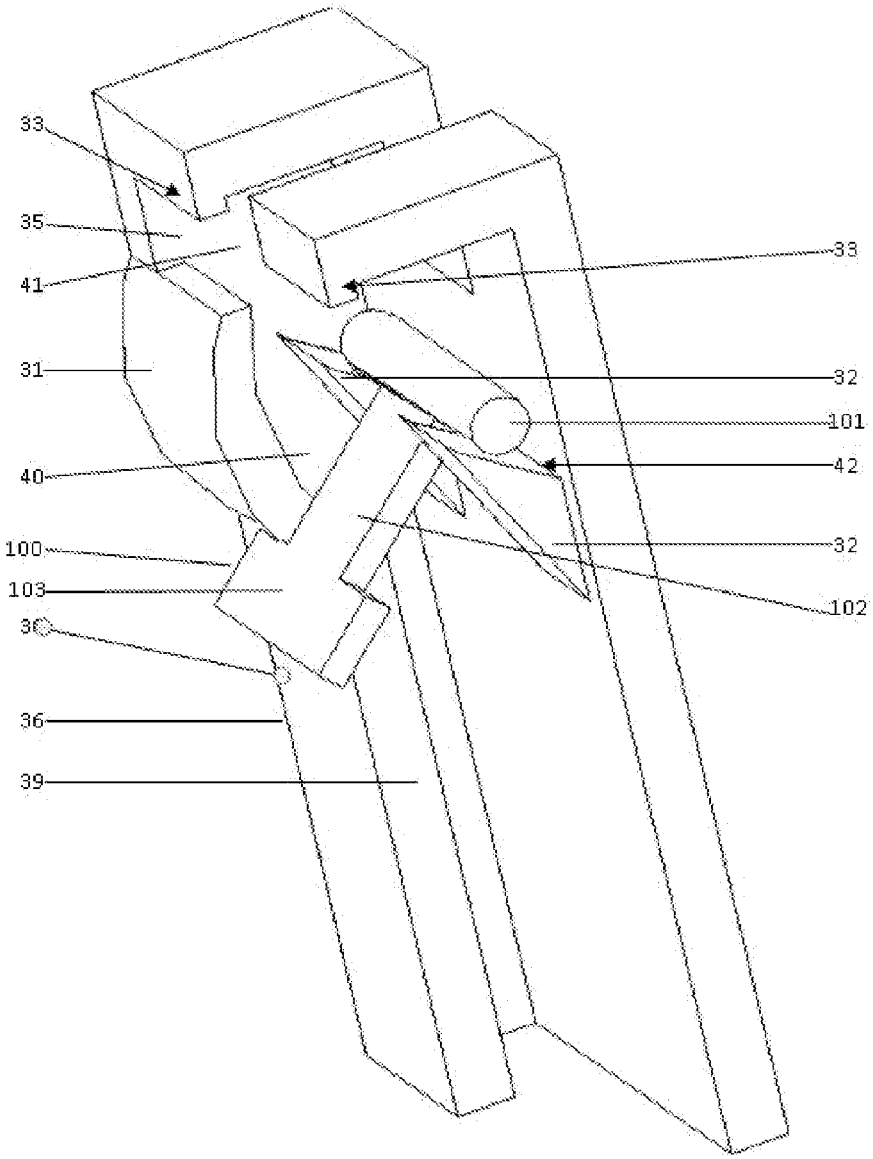
FIG. 15 is a cross-section view of the top of the upper track guides with a tab in place in the tab retention structure.

The waste bags (160) of the present invention are equipped with T-bar tabs (100) integrated into the fringes of the waste bags (160). The T-bar tabs (100) employed by the preferred embodiment of the present invention are preferably T-shaped, and are equipped with a bag connection point (103), a cylinder (101) configured to slide within the slot (14) of the rail (10), and a junction point (102) connecting the cylinder (101) to the bag connection point (103) as seen in FIG. 13. The T-bar tabs (100) serve as the connection means between the rails (10) and the waste bags (160), and are designed to fit within the inner slot area (39) of the rails (10) of the present invention as seen in FIG. 15 and FIG. 12. The T-bar tabs (100) are configured to interface with the rails (10) of the receptacle of the present invention, and facilitate the guidance of the waste bags (160) from the waste bag cartridge (141) to the deployed, open position.

Figure 7:
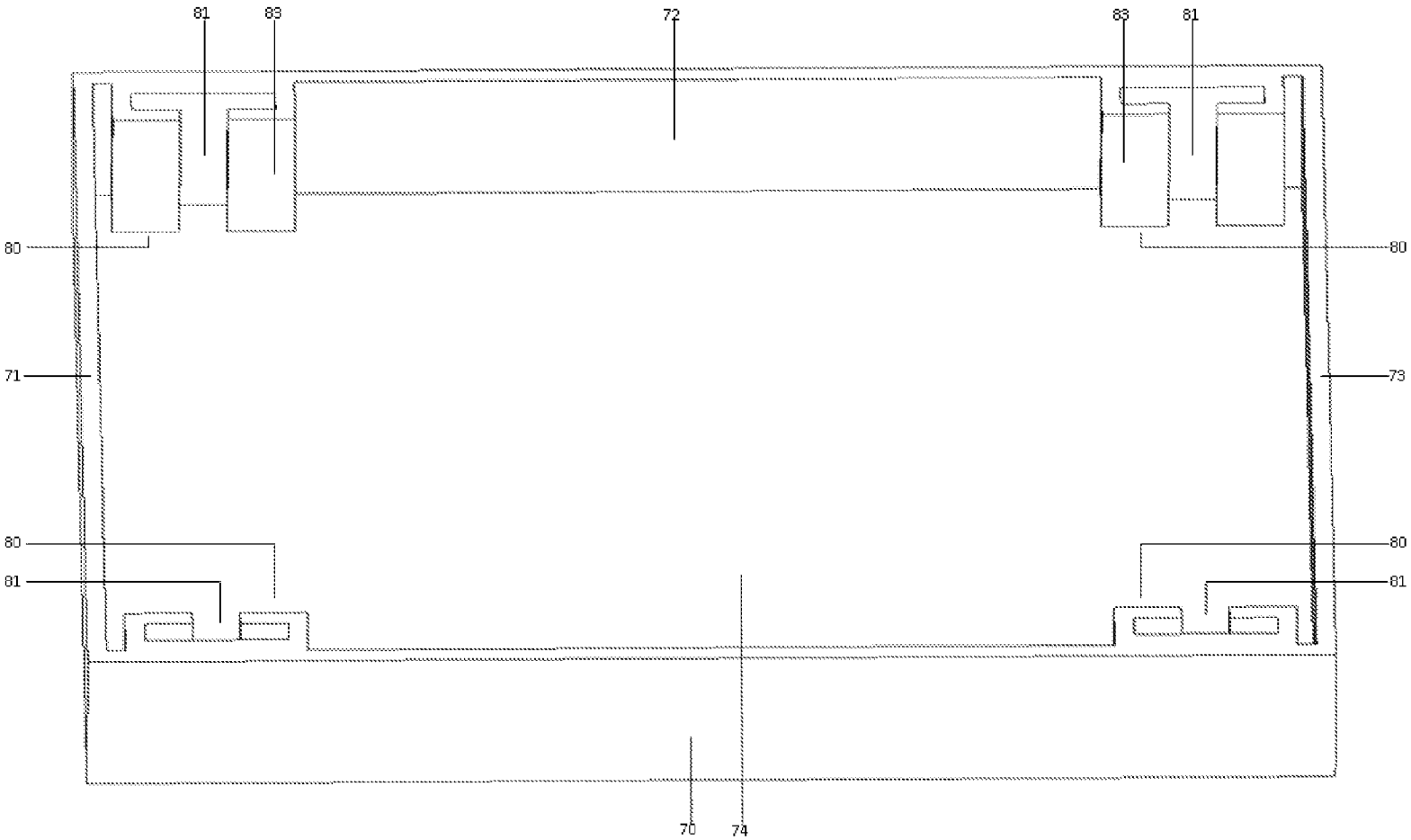
FIG. 7 is a perspective view of the waste bag cartridge without waste bags.
Figure 8:
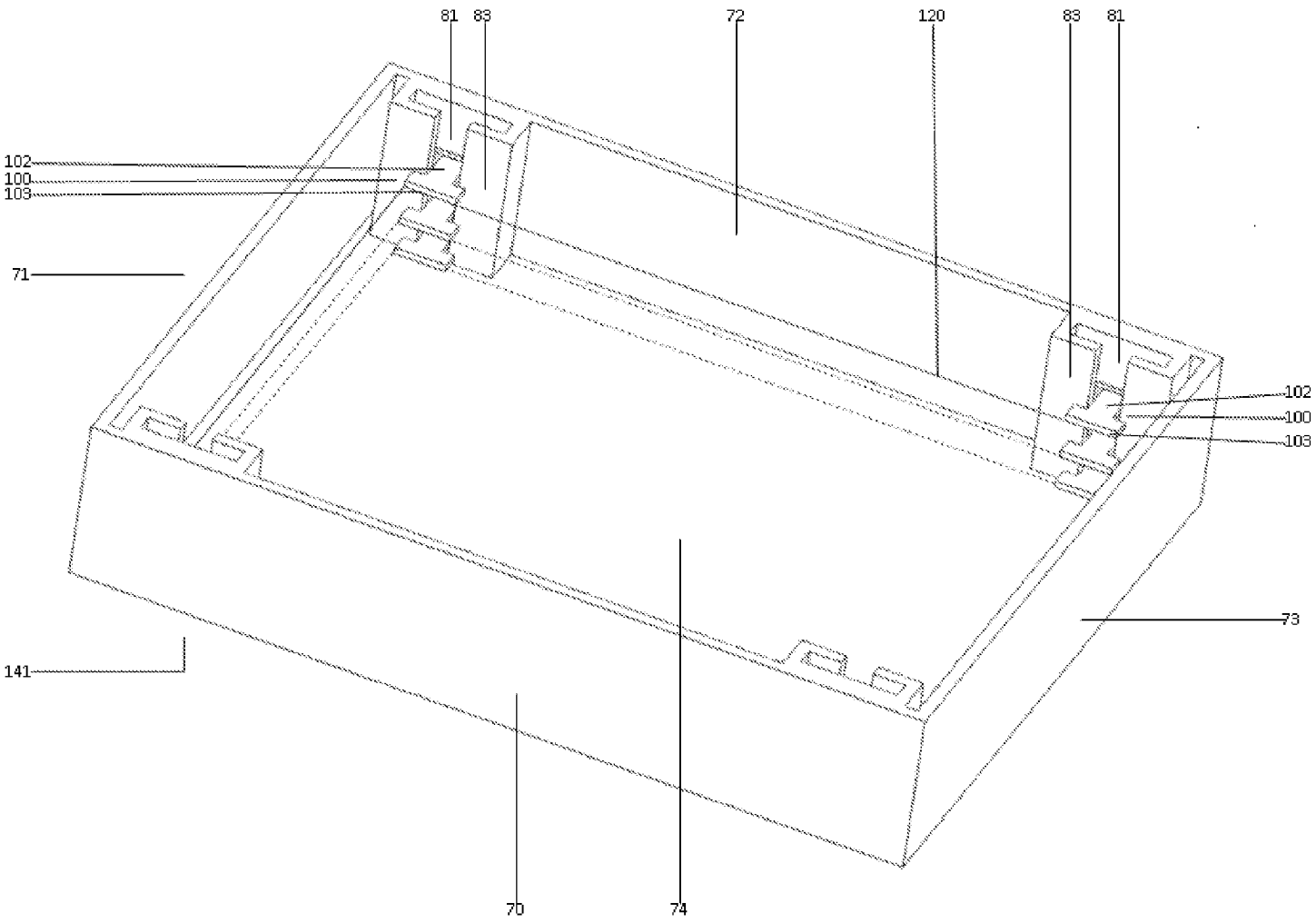
FIG. 8 is a perspective view of the waste bag cartridge with waste bags.
Figure 9:
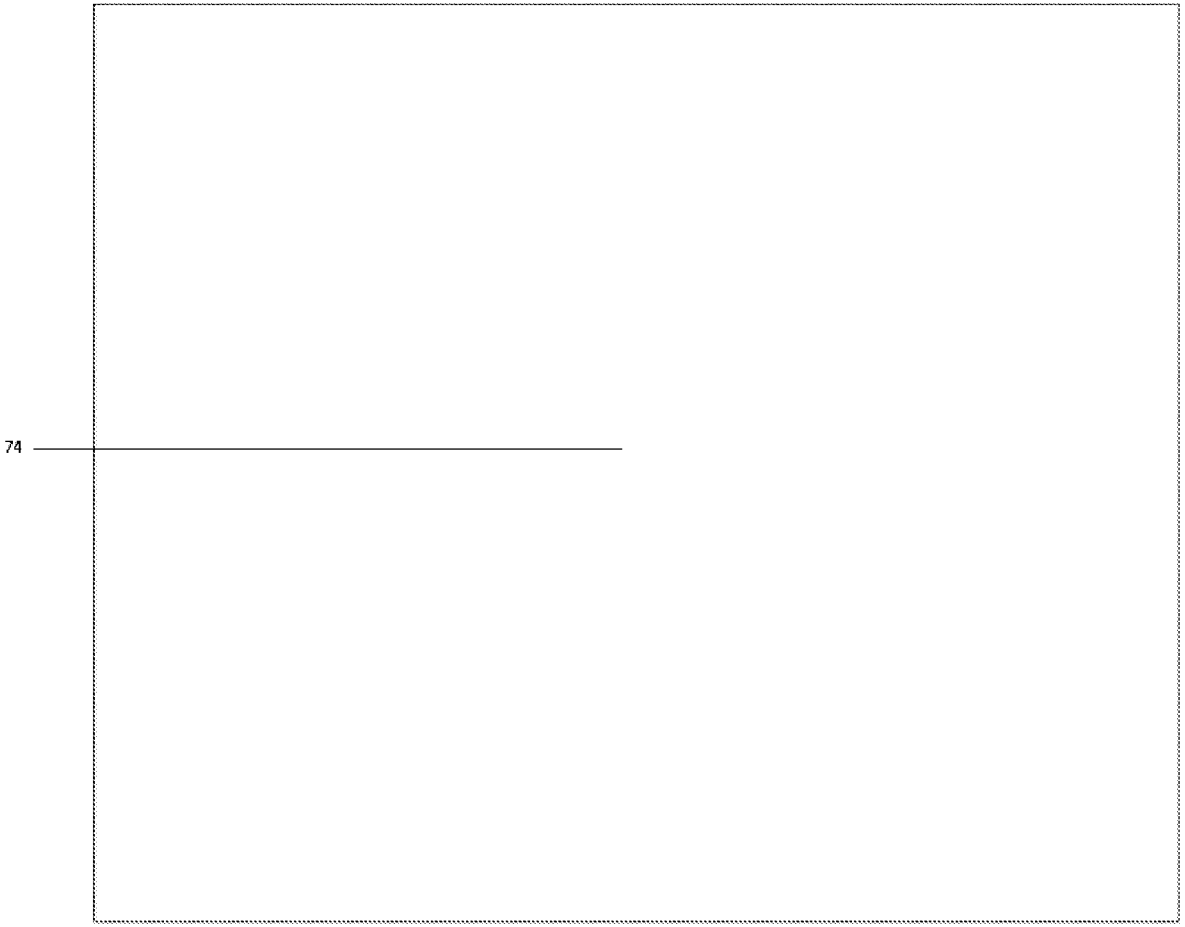
FIG. 9 is a perspective view of the bottom of the waste bag cartridge.

The waste bag cartridge (141), as seen in FIGS. 7-8, as well as best seen in FIG. 15, is configured to hold a plurality of waste bags (160). When a used, full waste bag (160) is removed from the receptacle, the waste bag cartridge (141) is configured to position a subsequent clean waste bag (160) in an open and ready-to-use state. The waste bag cartridge (141), when installed within the receptacle of the present invention, is preferably positioned directly below the rails (10). The waste bag cartridge (141) of the preferred embodiment of the present invention is equipped with a T-bar tab retention mechanism (20, 21) configured to securely inhibit the movement of the T-bar tabs (100) when within the rails (10) of the receptacle of the present invention, ensuring that the waste bags (160) may be easily removed and deployed without strain or sustained effort by the user. As seen in FIG. 7, the waste bag cartridge preferably has a front outer wall (70), a left outer wall (71), a rear outer wall (72), a right outer wall (73) and a cartridge floor (74). The slot (14) of the rails (10) preferably aligns with a cartridge slot (81) held within a rail extension (80) found within the waste bag cartridge (141). A rail connection point (82) provides for the junction between the rail extensions (80) and the rails (10). Similar to the rails (10), the rail extensions of the waste bag cartridge are equipped with a rail extension face (83), a rail extension side (84), and a rail extension rear (85), as seen in FIG. 7.

In the preferred embodiment of the present invention, the waste bag cartridge (141) is ideally positioned below the rails (10) at the bottom of the receptacle when installed within the receptacle such that the empty waste bags (160) remain at the bottom of the receptacle until they are needed. The waste bag cartridge (141) is preferably attached and installed by a user by horizontally placing the waste bag cartridge (141) into the receptacle by sliding the cartridge into opening found at the bottom of the receptacle, under the bottom of the rails (10). The waste bag cartridge (141) preferably slides into the bottom of the receptacle similar to a paper tray in a conventional copy machine, however in the preferred embodiment of the present invention, the entire waste bag cartridge (141) is replaced when all of the waste bags (160) have been used and disposed of. A T-bar tab (100) is preferably located on each of the sides or corners of the waste bags (160). The T-bar tabs (100) are configured to slide within the inner slot area (39) of the rails (10), which preferably extends from the top of the receptacle, vertically to the bottom of the receptacle.

Figure 10:
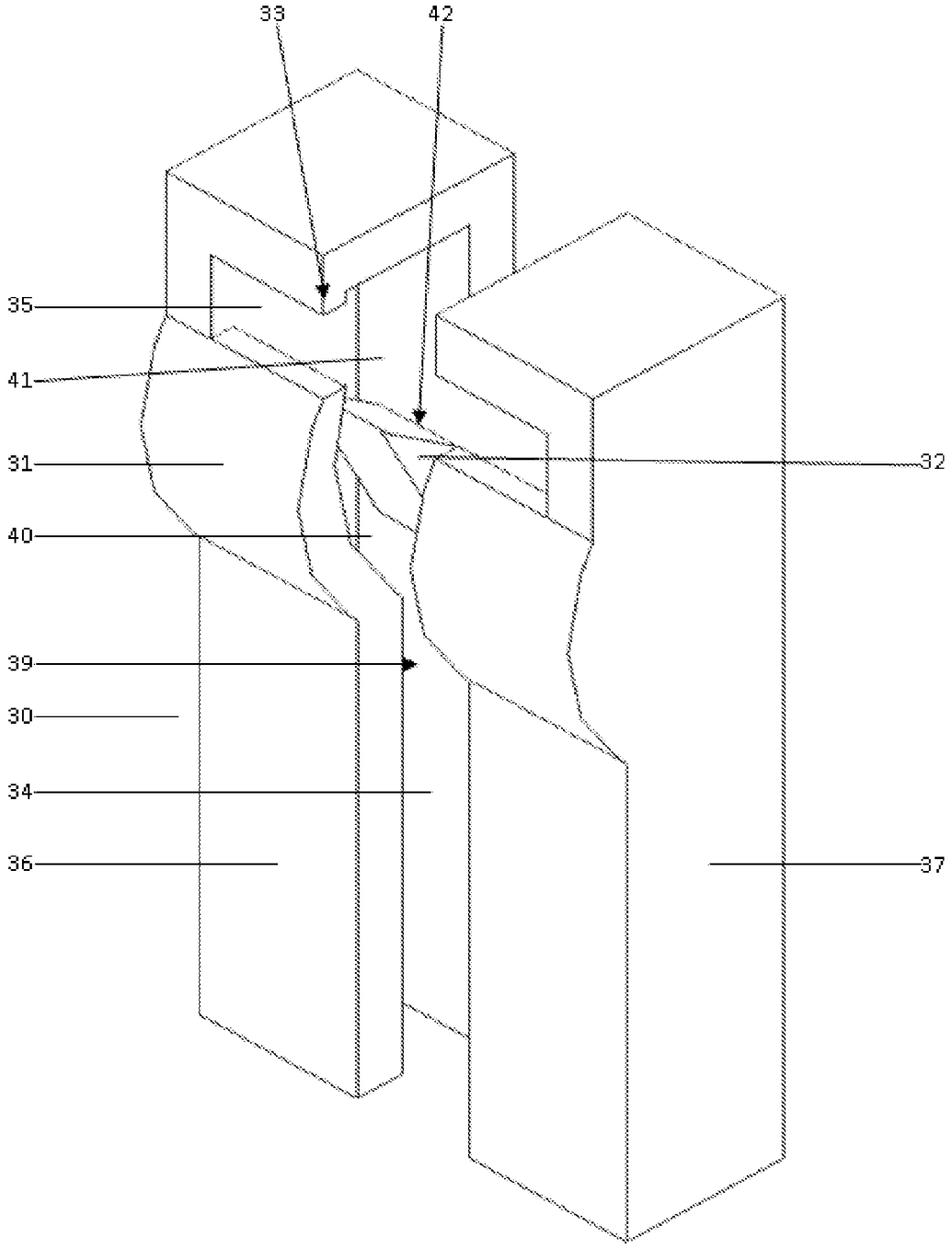
FIG. 10 is a detailed view of the top of the upper track guides with tab retention structure.
Figure 11:
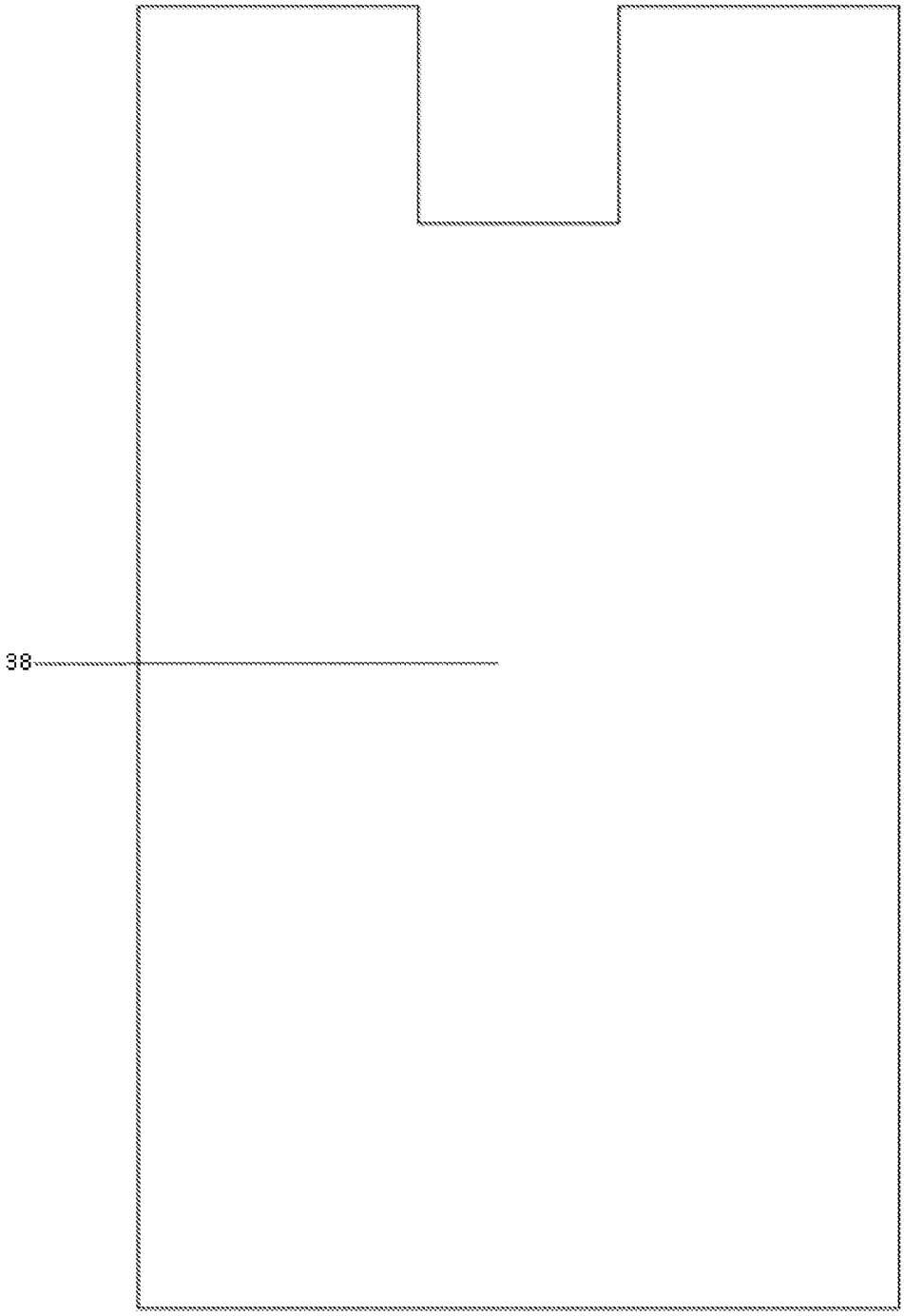
FIG. 11 is a perspective view of the back of the track guides.

In the preferred embodiment of the present invention, the T-bar tabs (100) are preferably T-shaped, and are placed within the inner slot area (39) of the rails via a cylindrical member (101), which provides for the T-bar tabs (100) to pivot vertically on the cylindrical member (101), slide up into position on the rails (10), and remain at the top of the receptacle when in use. A series of hooks (12, 13) are preferably located near the exit opening (15, 35) of each rail (10). The series of hooks (12, 13) are designed to ensure that the T-bar tabs (100) do not exit the rail (10) via the slot (14) or fall to the bottom of the receptacle without deliberate action by the user. A catch area (42) near each of the series of hooks (12, 13) is configured to prevent each T-bar tab (100) and attached single instance of the waste bags (160) from falling to the bottom of the receptacle as seen in FIG. 10, as well as to prevent the T-bar tabs (100), and thus the waste bags (160) from prematurely being pulled from the receptacle.

The waste bags (160) are configured to be temporarily linked to one another in a sequential chain of waste bags (160) while housed within the waste bag cartridge (141). As a full waste bag (160) is removed from the receptacle, a subsequent empty waste bag (160) remains temporarily affixed to the bottom of the full waste bag (160), providing for the clean waste bag (160) to be deployed with the act of waste bag removal. The waste bags (160) held within the waste bag cartridge (141) are preferably temporarily affixed together sequentially via a conventional perforation point, which provides for the bags to remain bound together during transit and placement of the waste bag cartridge (141) onto the rails (10) of the receptacle. However, alternate embodiments of the present invention may employ a weak adhesive, static electricity, and/or any other conventional method for temporarily connecting conventional waste bags, to temporarily connect sequential waste bags (160) together within the waste bag cartridge (141). The perforation point preferably requires a steady application of force in order to separate the waste bags (160) from one another. When the waste bags (160) are held within the waste bag cartridge (141), the T-bar tabs (100) (matching or aligning to subsequent waste bags (160) according to a shared physical location) are stacked on top of one another vertically as seen in FIG. 8 at the cartridge floor (74).

The preferred embodiment of the present invention is equipped with a screen (150) which surrounds the exterior of the receptacle. The screen (150) provides the means for air to enter the receptacle when a waste bag (160) is being removed from the receptacle. Conventionally, when a regular waste bag is removed from a traditional trash can, a small vacuum is formed within the trash can as the regular waste bag often binds against the walls of the trash can, causing air to be unable to enter the space being created beneath the bag as it is removed, causing removal to be strenuous. The screen (150) serves to eliminate this problem by providing an established passage for air to enter the cavity under a waste bag (160) as it is being removed from the receptacle.

Alternate embodiments of the present invention may employ a waste bag cartridge (141) that is reusable and may be reloaded with the T-bar tab (100) equipped waste bags (160) of the present invention. In order to do this, the user preferably aligns a T-bar tab (100) with the rail (10) and slot (14) found at each of the corners of the waste bag cartridge (141), as seen in FIG. 1, and slides the bags into position within the waste bag cartridge (141) for later use.

Figure 16:
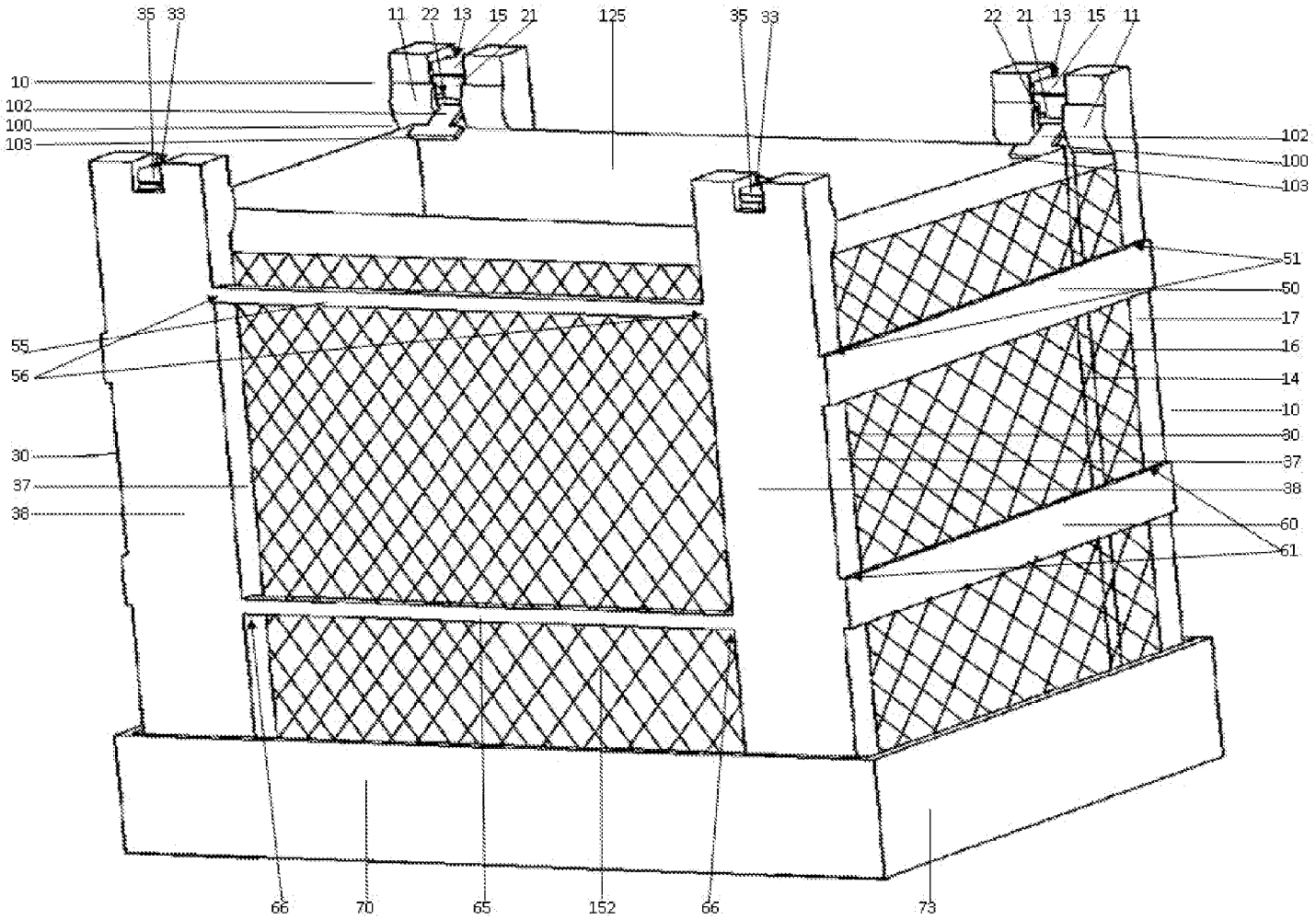
FIG. 16 is a perspective view of the preferred waste bag apparatus with a waste bag cartridge, upper track guides, side rails, a waste bag and screen.
Figure 17:
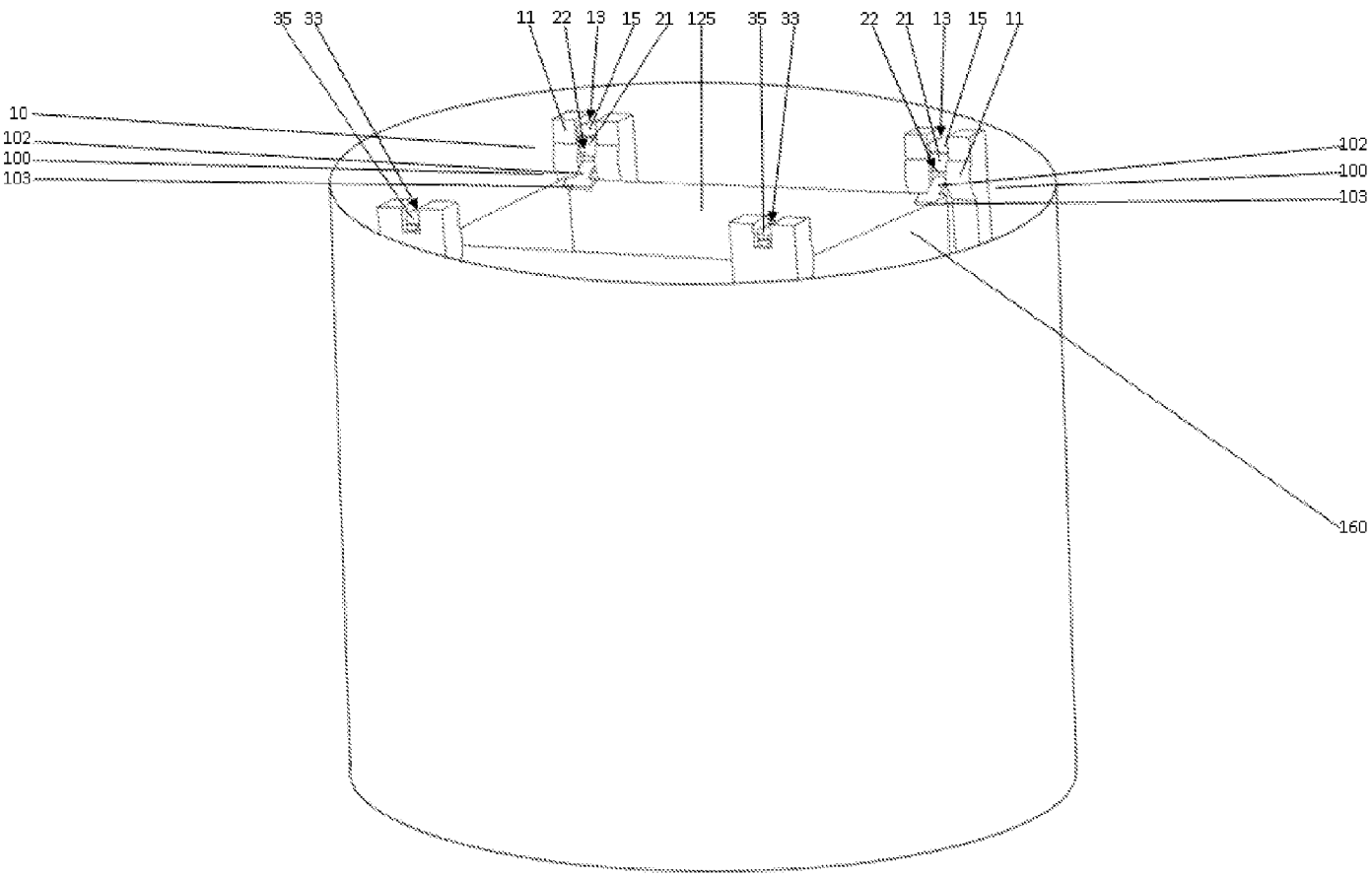
FIG. 17 is a perspective view of the preferred waste bag apparatus inserted into an outer enclosure.

FIG. 17 depicts a form of alternate embodiment of the present invention in that the rails (10) of the present invention are implemented into a conventional waste can in order to allow for the use of the waste bag cartridge (141) of the present invention to be used with a conventional waste can rather than the receptacle shown in FIG. 16. FIG. 16 show the present invention as equipped with the screen (150) integrated into the receptacle in order to prevent a vacuum seal during full waste bag extraction.

Additional alternate embodiments of the present invention may employ variations on the shape, size, and strength of the T-bar tabs (100). For example, alternate embodiments of the present invention may employ T-bar tabs (100) that are similar to a ball joint socket in that a sphere or small cube could be configured to be affixed to a tab bound to the waste bags (160) in order to accomplish the same goal as the T-bar tabs (100) described. Additionally, T-bar tabs (100) designed to be employed on heavy duty bags may employ multiple bag connection points (103) in order to ensure that the T-bar tab (100) does not easily separate from the waste bag (160) itself. In all embodiments of the present invention, the T-bar tabs (100) are preferably bound to the waste bags (160) during manufacturing via melting, crimping, or a strong adhesive. The T-bar tabs (100) are preferably affixed to the waste bags (160) near the conventional drawstring that is incorporated into the top of conventional waste bags. Additionally, it should be understood that the T-bar tabs (100) of the present invention may be envisioned and become available in a wide variety of shapes and sizes. For this reason, as mentioned previously, the T-bar tabs (100) need not be in the shape of a T in all embodiments of the present invention. For this reason, in general, the T-bar tabs (100) are formally a form of connecting tab, and maybe referred to as such. Similarly, it should be understood that, in alternate embodiments of the present invention, the waste bag cartridge (140) of the present invention may be reusable. In such an embodiment, waste bags (160) equipped with t-bar tabs (100) may be sold separately, and placed within the waste bag cartridge (140) when it is empty.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

I claim:

1. A waste management apparatus comprising:

a waste bag cartridge;

wherein said waste bag cartridge contains at least one waste bag;

wherein said at least one waste bag is configured with an opening and an edge of said opening;

at least one connecting tab;

wherein said at least one connecting tab is affixed to said edge of said opening;

at least one rail;

wherein said at least one rail has a slot, said slot extends from a first end of said rail to a second end of said rail;

wherein said at least one connecting tab is configured to slide within said slot; and wherein said at least one waste bag is connected in sequence to subsequent at least one waste bags temporarily such that when a full waste bag is removed from said slot, the subsequent at least one waste bag is raised into an open position via said slot.

2. The waste management apparatus of claim 1, further comprising said at least one rail is equipped with at least one hook maintaining said at least one waste bag in position via said at least one connecting tab.

3. The apparatus of claim 2, wherein said at least one waste bag are connected sequentially temporarily via a perforation.

4. The apparatus of claim 2, wherein said at least one waste bag are connected sequentially temporarily via a weak adhesive.

5. The waste management apparatus recited in claim 1, wherein said at least one waste bag are connected sequentially temporarily via a perforation.

6. The apparatus of claim 3, further comprising said at least one rail is equipped with a locking mechanism maintaining said at least one waste bag in position via said at least one connecting tab.

7. The apparatus of claim 1, wherein said connecting tab is constructed of plastic.

8. The apparatus of claim 1, wherein said connecting tab is affixed to said at least one waste bag via adhesive.

9. The apparatus of claim 1, wherein said at least one connecting tab is fused to said at least one waste bag during the manufacturing process via heat.

10. The apparatus of claim 1, wherein said at least one connecting tab is one of the following: a t-bar tab, a square shaped tab, a spring-loaded lock-in-place tab, and a spherical tab.

11. A waste management apparatus comprising:

a waste bag cartridge;

wherein said waste bag cartridge contains at least one waste bag;

wherein said at least one waste bag is configured with an opening and an edge of said opening;

at least one connecting tab;

wherein said at least one connecting tab is affixed to said edge of said opening of said at least one waste bag;

at least one rail;

wherein said at least one rail has a slot;

wherein said slot extends along the length of said at least one rail;

wherein said at least one connecting tab is configured to slide within said slot; and wherein said at least one waste bag is connected in sequence to subsequent at least one waste bags temporarily such that when a full waste bag is removed from said slot, the subsequent at least one waste bag is raised into an open position via said slot.

12. The apparatus of claim 11, wherein said at least one connecting tab is affixed to said at least one waste bag via heat fusing said connecting tab to said at least one waste bag.

13. The apparatus of claim 11, further comprising a screen encompassing said at least one rail and said at least one waste bag.

14. The apparatus of claim 11 wherein said at least one waste bag attachment mechanism is one of the following: a t-shaped tab, a spring-loaded lock-in-place tab, a square shaped tab, and a spherical tab.

15. The apparatus of claim 11, wherein said at least one connecting tab is affixed to said at least one waste bag via adhesive.

16. A waste management apparatus comprising:

a waste bag cartridge;

wherein said waste bag cartridge is configured to hold a plurality of waste bags;

wherein said waste bag cartridge is refillable;

at least one rail;

wherein said at least one rail has a first end and a second end;

wherein said at least one rail has a slot, said slot extends from said first end to said second end;

wherein said waste bag cartridge is disposed at said second end of said at least one rail;

at least one secondary rail, wherein said at least one secondary rail is disposed above and in alignment with said at least one rail;

at least one retaining mechanism disposed at said first end of said at least one secondary rail;

wherein said slot is aligned with said waste bag cartridge;

at least one waste bag; said at least one waste bag configured to fit within said waste bag cartridge;

at least one waste bag connection tab;

wherein said at least one waste bag connection tab is affixed to an edge of an opening of said at least one waste bag;

wherein said at least one waste bag connection tab is configured to slide within said slot; and wherein said at least one retaining mechanism is configured to interlock with said at least one waste bag connection tab.

* * * * *